United States Patent [19]

Ong

[11] Patent Number: 4,977,632

[45] Date of Patent: Dec. 18, 1990

[54] LOW-COST SLEEPING BAG

[75] Inventor: Alex Ong, Victoria, Australia

[73] Assignee: Visy Board Properties Pty. Ltd., Kew, Australia

[21] Appl. No.: 448,355

[22] Filed: Dec. 11, 1989

[30] Foreign Application Priority Data

Oct. 16, 1989 [AU] Australia ..... PJ6887

[51] Int. Cl.[5] ..... A47G 9/08

[52] U.S. Cl. ..... 5/413; 5/502; 2/69.5

[58] Field of Search ..... 5/413, 487, 502; 2/69.5; 383/110

[56] References Cited

U.S. PATENT DOCUMENTS

| | | | |
|---|---|---|---|
| 274,690 | 3/1883 | Willey | 5/502 X |
| 2,625,695 | 1/1953 | Nicholson | 5/487 X |
| 2,825,912 | 3/1958 | Sawtell et al. | 5/487 |
| 3,137,871 | 6/1964 | Florio | 5/502 X |
| 3,460,170 | 8/1969 | Uzier | 5/487 X |

*Primary Examiner*—Michael F. Trettel

*Attorney, Agent, or Firm*—Dennison, Meserole, Pollack & Scheiner

[57] ABSTRACT

A low-cost sleeping bag comprising a sheet of recycled lining paper formed into overlying loops to define a envelope closed at one end and open at the other, and intermediate layers of corrugated or dimpled paper inserted between the overlying portions of the overlying loops to provide cushioning and insulative properties.

4 Claims, 3 Drawing Sheets

R
1
S
T
3
2

R
1
2
T
8
7
6
3
5
I1
4
S

R
1
I2
I1
T
3 5
9
6 7 8
4
S

R
1
11
I1
I2
9
T
10
12
4
S

LOW-COST SLEEPING BAG

FIELD OF THE INVENTION

This invention relates to sleeping bags and similar protective devices for protecting persons against exposure to the cold.

BACKGROUND OF THE INVENTION

Sleeping bags are widely used to keep a sleeping person warm in exposed cold environments. Most known sleeping bags are made from cloth layers with one or more interposed layers of fibrous material, such as down, feathers and various synthetic fibrous materials. Such sleeping bags are therefore expensive in construction and are not suitable for use for homeless persons or for short term use as a disposable sleeping bag.

SUMMARY OF THE INVENTION AND OBJECT

It is an object of the present invention to provide a low-cost sleeping bag which may be used for homeless persons, in various emergency situations, or as a short term use disposable sleeping bag.

The invention provides a sleeping bag for body heat conserving device comprising a composite paper envelope sealed at one end and opened at the other end, said envelope comprising an inner layer of paper, an overlying outer layer of paper with at least one intermediate layer of corrugated or dimpled paper to provide cushioning an insulative properties.

By making the bag from paper, the manufacturing cost may be minimised to the extent that the bag may be used for the homeless, or as a disposable bag for short term use, such as for short hikes, or in emergencies. Another advantage of making the bag from paper is that it is biodegradable and may be disposed of without any significant pollution of the environment.

In a preferred form of the invention, the inner and outer layers of paper are formed from a single sheet of paper formed into overlying loops, the intermediate layer(s) of corrugated or dimpled paper being inserted between those overlying portions of the inner and outer layers of paper which constitute the top and bottom layers of the bag.

In a particularly preferred form of the invention, the intermediate layer comprises a first sheet of corrugated or dimpled paper, a second sheet of flat paper and a third sheet of corrugated or dimpled paper in register with the first and second sheets.

The exposed surface of the outer layer of paper is preferably coated by means of a wax-based waterproof or water resistant coating of the type used in the packaging industry. Other waterproof or water resistant coatings may be used instead of wax-based coatings.

The sealed end of the envelope is preferably sealed by means of adhesive tape and the open end of the envelope is preferably taped around the rim to seal the outer layer to the inner layer and prevent removal of the intermediate layer.

The envelope and the intermediate layers are preferably made from recycled paper and the major constituents of the sleeping bag are biodegradable when exposed to the elements.

BRIEF DESCRIPTION OF THE DRAWINGS

A presently preferred embodiment of the invention will now be described with reference to the accompanying drawings in which.

DESCRIPTION OF PREFERRED EMBODIMENT

Figures 1, 2, 3, 4:
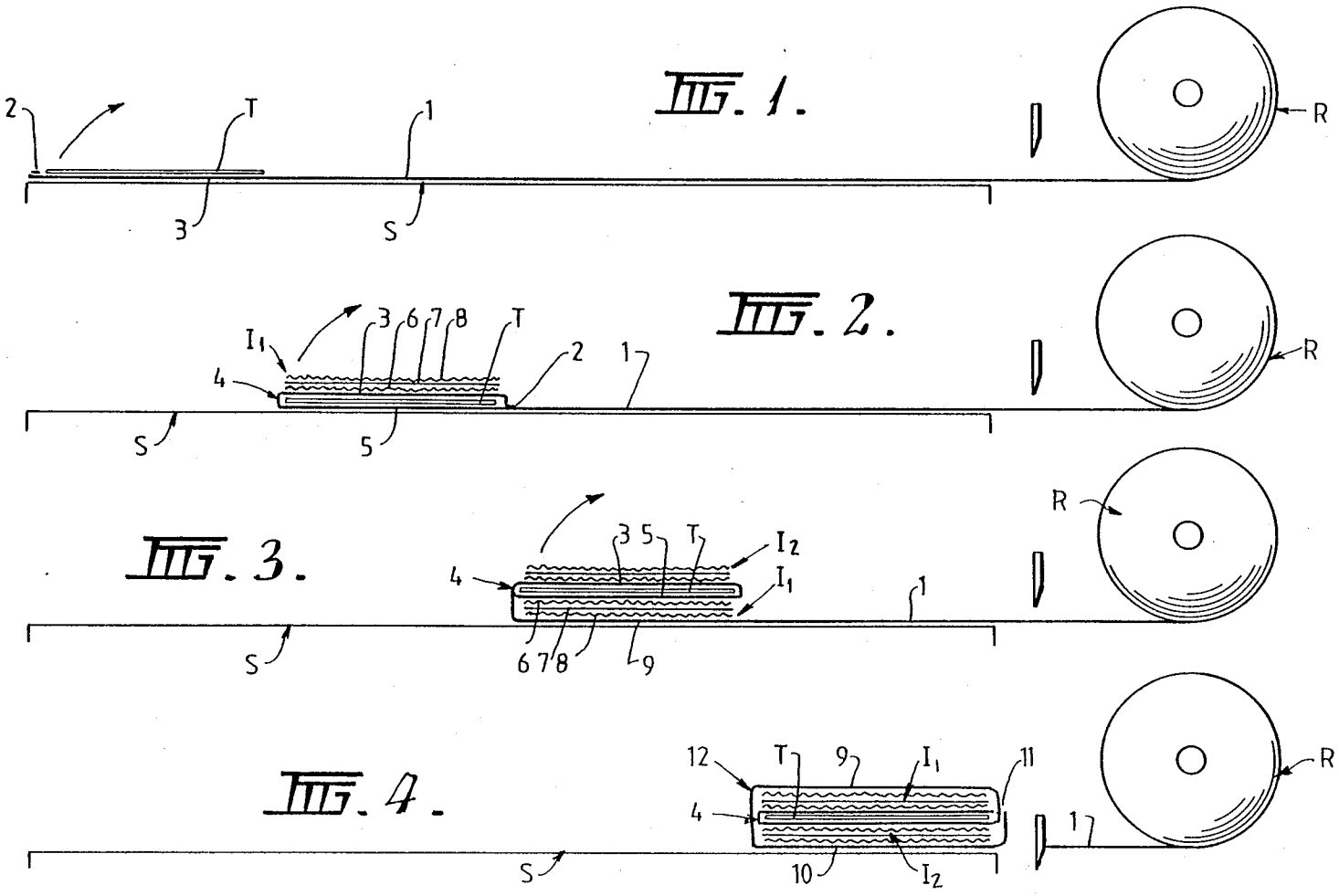
FIGS. 1 to 4 are schematic representations of the steps involved in the manufacture of a sleeping bag embodying the invention.

Referring firstly to FIGS. 1 to 4 of the drawings, the steps involved in making a sleeping bag embodying the invention are shown. In the first step shown in FIG. 1 of the drawings, a length of recycled liner paper 1 (about 150 gsm) is drawn from a roll R and position on a supporting surface S. A template T having slightly smaller dimensions than those of the desired sleeping bag is positioned adjacent the end of the liner sheet 1 and a strip of doublesided adhesive 2 is applied to the end of the liner sheet 1 and the sheet end portion 3 of the sheet 1 and the template T are folded over until the free edge of the sheet 1 contacts and is adhered to the top surface of the sheet 1 by the adhesive strip 2.

As shown in FIG. 2 of the drawings, the above operation defines a central envelope 4 defined by the portion 3 and underlying portion 5 of the sheet 1.

Figure 6:
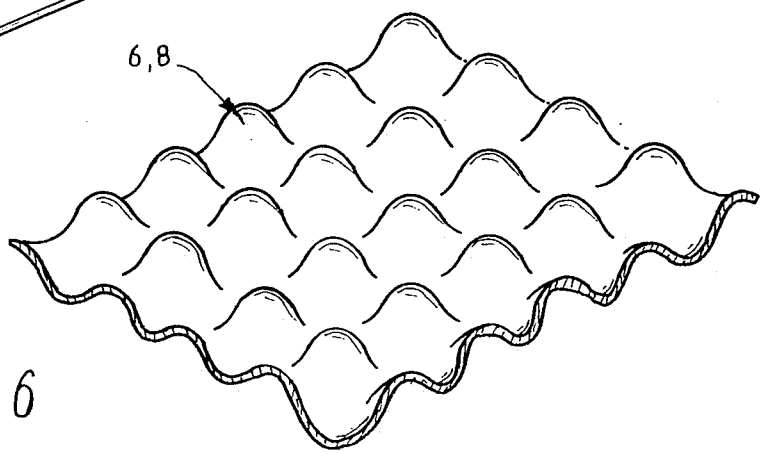
FIG. 6 is a fragmentary perspective view of one form of material used in the manufacture of the sleeping bag.

In the next stage shown in FIG. 2 of the drawings, a composite insulating insert $I_1$ comprising a first retangular sheet of dimpled cushioning liner 6, of the type shown in FIG. 6 of the drawings, an interposed rectangular sheet 7 of lining paper similar to the sheet material 1, and a second rectangular sheet of dimpled lining paper 8 positioned on the sheet 7 to define the composite insulating insert $I_1$.

The central envelope 4, the template T and the composite insulating insert $I_1$ is then folded in the direction of the arrow shown in FIG. 2 until the insert 1 is positioned on a portion 9 of the liner sheet 1 which will define one of the outside surfaces of the completed bag. A second composite insulating insert $I_2$ similar to the insert $I_1$ is positioned on top of the folded assembly, as shown in FIG. 3 of the drawings.

The assembly is again folded in the direction of the arrow in FIG. 3 so that the composite insulating $I_2$ is positined on a portion 10 of the sheet 1, which constitutes the other outside surface of the bag. The sheet 1 is then slit by means of a knife, as shown schematically in FIG. 4 of the drawings, and the free end portion of the sheet 1 is adhered to the outer surface of the assembly by means of a strip of double-sided adhesive 11, to define an open ended envelope 12. As an alternative to the use of double-sided adhesive, any acceptable box making glue commonly used in the packaging industry may be applied to the sheet 1 in place of the adhesive strips 2 and 11.

Figure 5:
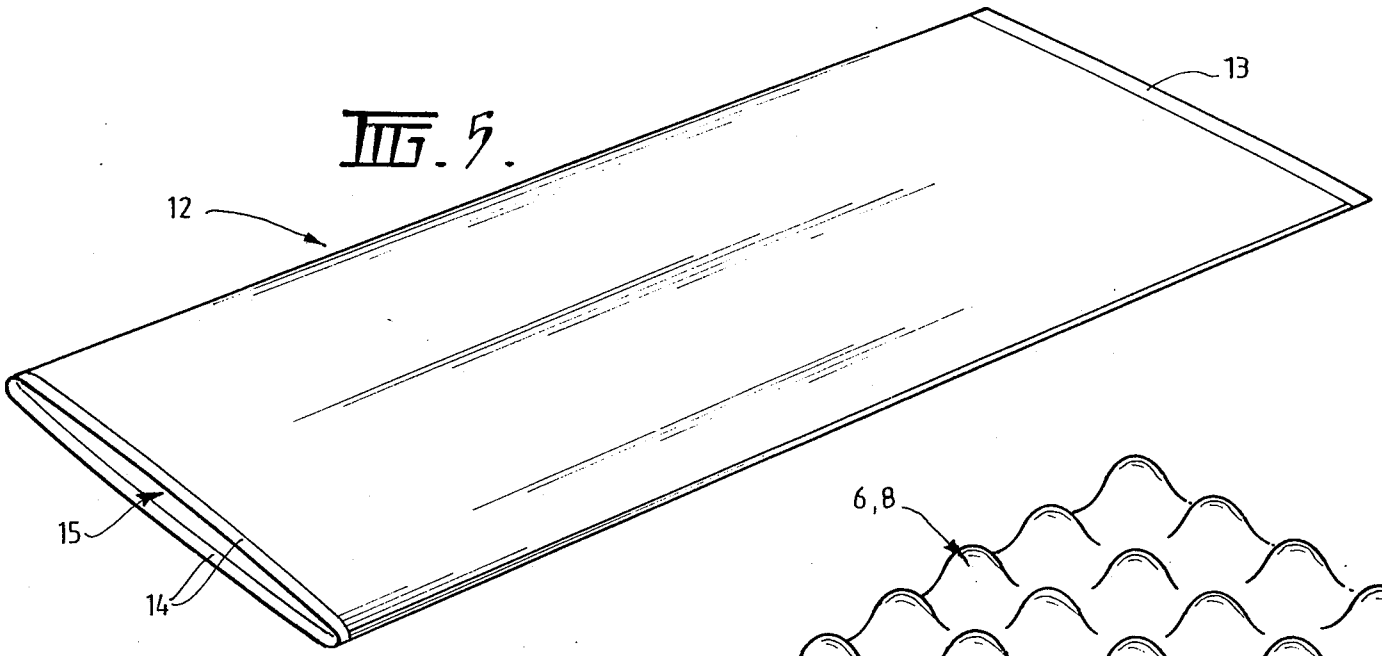
FIG. 5 is a perspective view of a completed sleeping bag embodying the invention.

Referring now to FIG. 5 of the drawings, one open end of the envelope 11 is closed by means of suitable adhesive tape 13 while the edges of the other open end of the envelope 12 are similarly closed by adhesive tape 14 to define the open mouth 15 of the completed sleeping bag.

The outer surface of the envelope 12 is coated with a wax-based waterproof or water resistant coating of the type commonly used in the packaging industry. While wax-based coatings are preferred, any other waterproofing or water resistant coating may be used.

Figure 7:
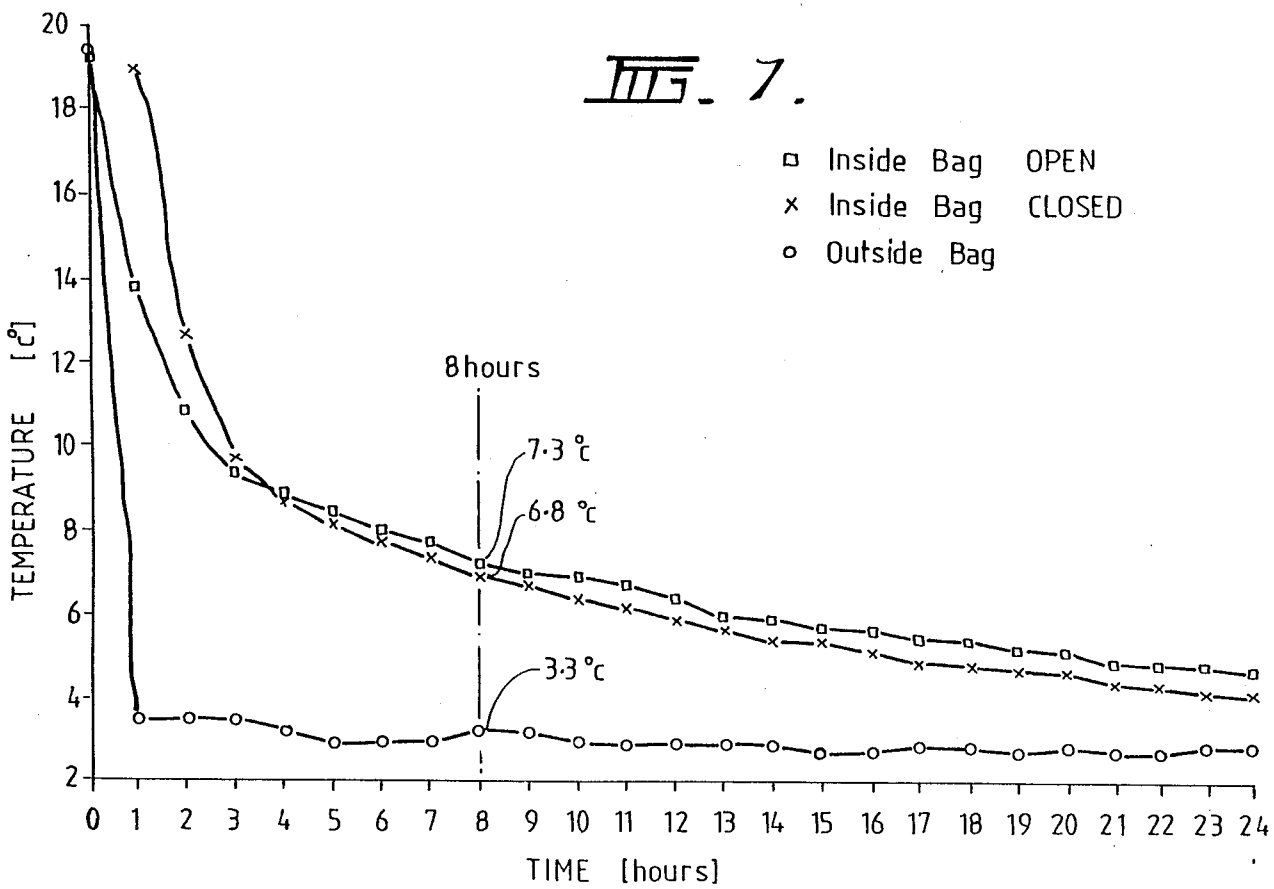
FIG. 7 is a graph illustrating the insulative properties of the bag.

The insulating properties of the sleeping bag embodying the invention are shown in FIG. 7 of the drawings. The temperature readings were taken over a 24 hour period from 10.00 p.m. in the evening to 10.00 p.m. the following evening in an artifically cooled enviroment. The temperature readings inside the bag with the bag open and closed were taken without a person occupying the bag. It will be appreciated that the addition of body heat within the bag would substantially increase the temperature within the bag while the bag acts to reduce the loss of heat from the bag.

While the use of dimpled liner of the type shown in FIG. 6 of the drawings is preferred to provide both cushioning and insulative properties, acceptable insulative and cushioning properties may be obtained by using a corrugated liner of the type used in the manufacture of cardboard boxes.

It will be appreciated from the above that the sleeping bag embodying the invention may be manufactured from recycled paper at a low cost and is therefore suitable for use by the homeless or for use as a disposable sleeping bag for short hikes or in emergency situations.

While the method of manufacture described above is presently preferred, it should be appreciated that a bag embodying the features of the present invention may be made by suitably folding overlying strips of liner paper, dimpled paper, liner paper and dimpled paper so that the sides of the bag are similarly insulated. It will be appreciated that bags made in accordance with the preferred embodiment are flatter and therefore more easily folded for storage and carrying than a bag made in accordance with the above described alternative.

I claim:

1. A sleeping bag or the like with body heat conserving properties comprising a composite envelope having opposed ends, said envelope being sealed at one end and open at the other end, said envelope comprising an inner layer of paper, an overlying outer layer of paper and an intermediate layer therebetween, said intermediate layer comprising a first sheet of corrugated or dimpled paper, a second intermediate sheet of flat paper overlying said first sheet of paper, and a third sheet of corrugated or dimpled paper in register with the first and second sheets and overlying said second sheet, said intermediate layer providing cushioning and insulative properties between said inner and outer layers.

2. The bag of claim 1 wherein said inner and outer layers of paper comprise a continuous single sheet of paper formed into overlying flat loops including an inner loop forming a body receiving cavity and an outer loop surrounding said inner loop, said loops defining a top and a bottom of the bag respectively above and below said body receiving cavity, said intermediate layer being between said inner and outer loops.

3. The bag of claim 2 wherein said top and said bottom are defined by overlying portions of said inner and outer layers, opposed sides joining said top and bottom, said intermediate layer being inserted solely between the overlying portions defining said top and said bottom, said sides being generally devoid of said intermediate layer whereby said bag has an easily folded generally flat configuration.

4. The bag of claim 3 including a waterproofing or water resistant material on said outer layer.

* * * * *